US005948256A

United States Patent [19]

Leung

[11] Patent Number: 5,948,256

[45] Date of Patent: Sep. 7, 1999

[54] CENTRIFUGE WITH CAKE CHURNING

[75] Inventor: Woon-Fong Leung, Sherborn, Mass.

[73] Assignee: Baker Hughes Incorporated, Houston, Tex.

[21] Appl. No.: 09/007,236

[22] Filed: Jan. 14, 1998

Related U.S. Application Data

[63] Continuation-in-part of application No. 08/916,660, Aug. 22, 1997.

[51] Int. Cl.[6] ..... B04B 1/00

[52] U.S. Cl. ..... 210/374; 210/360.1; 210/380.1; 210/380.3; 210/391; 210/409; 494/27; 494/36; 494/53; 494/54; 494/57; 494/59

[58] Field of Search ..... 210/360.1, 374, 210/375, 380.1, 380.3, 391, 409; 494/27, 50, 51, 52, 53, 54, 55, 56, 57, 58, 59, 36

[56] References Cited

U.S. PATENT DOCUMENTS

| | | | |
|---|---|---|---|
| 3,279,611 | 10/1966 | Rotel | 210/380.3 |
| 3,301,708 | 1/1967 | Rotel | 210/380.3 |
| 3,791,577 | 2/1974 | Lacher | 210/375 |
| 3,795,361 | 3/1974 | Lee | 494/53 |
| 5,403,486 | 4/1995 | Leung | 210/380.1 |
| 5,653,673 | 8/1997 | Deasi et al. | 494/27 |

*Primary Examiner*—David A. Reifsnyder
*Attorney, Agent, or Firm*—R. Neil Sudol; Henry D. Coleman

[57] ABSTRACT

A centrifuge includes a conveyor for moving cake along a cake flow path towards a cake discharge opening and further includes a baffle mounted to the conveyor and disposed along the cake flow path. The baffle is provided on an upstream side, facing substantially away from the discharge opening, with a concave profile or surface. This concave profile or surface serves to direct a portion of the cake, which is headed downstream along the cake flow path, into a recirculation or churning path directed partly back towards a pool. The recirculation or churning of the particulate material facilitates an enhanced washing thereof and improves the removal of valuable solutes or undesirable impurities from the cake.

21 Claims, 12 Drawing Sheets

CENTRIFUGE WITH CAKE CHURNING

CROSS-REFERENCE TO RELATED APPLICATION

This application is a continuation-in-part of application Ser. No. 08/916,660 filed Aug. 22, 1997, now allowed.

BACKGROUND OF THE DISCLOSURE

This invention relates to centrifuges, both of the continuous-feed filtering or screening type and the solid-bowl type. This invention also relates to an associated method for operating a centrifuge.

Industrial centrifugation processes for separating particulate material from various impurities include sedimentation and filtration. Generally, the particulate material is produced as a cake having different degrees of moisture depending on the type of particulate material and the particular separation process. The cake constitutes a heavy phase whereas a filtrate or centrate constitutes a light phase. In some applications, a mother liquor displaced from the dewatered cake by a washing process in a centrifuge is the valuable component while the cake is the reject. In other applications, resins or crystals in the cake are the valuable product, impurities in the cake being removed with the filtrate or centrate.

A decanter-type centrifuge has a conveyor in the form of one or more helical screw wraps rotating at a slightly different angular velocity from the velocity of the bowl or outer wall. Where the bowl has a solid wall with a cylindrical shell followed by a conical shell or beach and extends from a clarifier pool at an input or feed end of the centrifuge to a cake discharge opening or openings at an output end of the centrifuge, the centrifuge is known as a decanter or a solid bowl. A sedimentation process occurs in the cylindrical portion of the centrifuge and a dewatering of the cake in the conical dry beach area. Where the bowl is provided with one or more screen sections downstream and outside of the clarifier pool, the decanter-type centrifuge is known as a screenbowl centrifuge and performs a filtration process.

Another kind of filtration centrifuge is a pusher or pusher basket. Such a centrifuge includes a first cylindrical basket at an input end of the centrifuge and a second cylindrical basket of greater diameter at a cake output end of the centrifuge. The baskets rotate at a high angular speed. In addition, the baskets of this two-stage basket system are longitudinally reciprocatable relative to one another, whereby pusher plates shove the heavy phase particulate material in a layer along the first basket, from the first basket to the second basket, and along the second basket to a cake discharge port. Single-stage pushers or pushers with two-or-more stages such as quadruple-stage pushers are also available.

Filtering centrifuges have been used to wash the cake to remove the impurities. There are two types of washing: a spray wash and a flood wash. In a spray wash, wash liquid is applied to a localized area on the cake surface in an attempt to displace mother liquor which contains the impurities. Spray washing is used most commonly in a screen-bowl centrifuge where the cake height varies across the screen from a thin layer to a thick layer adjacent to the pressure face of the conveyor blade.

Another kind of centrifuge, used particularly for the dewatering and washing of thickened slurries with particulate solids, is a conical-screen centrifuge. The centrifuge wall includes a conical screen which has an increasing diameter in the cake flow direction. The particulate solids are held by the screen as the liquid filters through. The conical screen has the advantage that the cake experiences an increasing centrifugal gravitational force as the cake travels down to the large diameter of the cone. The centrifugal gravity is proportional to the radius of the screen for a given rotational speed of the basket. Another advantage of the increasing-diameter conical screen is that, for a given cake mass, the cake height and thus the resistance to liquid drainage are reduced as the cake moves towards the large-diameter end of the cone, owing to the conservation of mass. Both of these advantages enhance the dewatering of the cake. Also, spray washing is used in conical-screen centrifuges to remove impurities dissolved in the mother liquor.

In a conical-screen centrifuge, a thickened or concentrated feed is introduced, after pre-acceleration to the proper tangential speed, into the centrifuge at the smaller end of the conical screen. The cake travels down the cone when the half cone angle, typically 30° to 40° with respect to the axis of the machine, is steep enough to overcome frictional forces.

When the cone angle is small, typically 15° to 25°, a mechanical conveyance mechanism is used to convey the cake from the small end of the cone to the large end thereof One mechanism is a helical screw conveyor with a single continuous lead. Another, related, mechanism is a multiple-lead screw conveyor (4 leads is common). Yet another mechanism is a set of discrete scraper blades each conforming to a helix. In any case, the conveyor rotates at a differential speed as compared to the screen, thereby conveying cake down the screen. By adjusting the differential speed, the cake movement and concomitantly the cake residence time can be adjusted. Another mechanism is a vibrator, such as rotation of eccentric weights with an axis of vibration parallel to the axis of the machine. The inertia force generated by the vibration propels the cake from the small end to the large end, the discharge end, of the centrifuge.

Pusher centrifuges are excellent for washing crystals for particles having a size greater than 75–100 microns, while screen bowls provide adequate washing when the mean particle size of the processed crystals is larger than 45 microns. For chemical applications such as in fine resins separation where particles are in the 5 to 30 micron range, both types of equipment are limited by fine solids passing through the screen. Instead, batch perforate basket centrifuges are used with a filter cloth having fine openings to prevent loss of fine solids in the filtrate. Batch processes, however, require the use of surge tanks for interim storage and introduction of the feed, which may be unacceptable in certain applications. Also, with both batch and continuous centrifugal filters, the centrifugal force is limited to a maximum of 1000–2000 g, which is inadequate for dewatering fine particles with low-permeability cake. Furthermore, the moisture trapped in the capillaries of the cake for the batch basket can be significant, especially for fine particles. This is compensated in part in the batch basket process by providing a long washing and dewatering time, with the result of a lower solids throughput.

Solid-bowl decanters have been used for washing fine resins without the disadvantage of losing the fine particles. In one application, the resin slurry after exiting a reactor is introduced into a decanter centrifuge wherein the cake is first dewatered in a dry beach area and subsequently washed with an appropriate liquid to displace the cake mother liquor (the valuable part), which flows back to the pool. The mother liquor is then discharged with the centrate. The cake (reject part) is dewatered before discharge. In another application using a solid-bowl centrifuge, the resin or crystal solids are the valuable component. By washing, the impurities in the cake are reduced before the cake is discharged from the solid-bowl centrifuge. The impurities dissolved in the wash liquid leave the machine with the centrate.

However, with the solid bowl, the washing which takes place in the dry beach after the cake has been conveyed by the screw is limited as the retention time is very short, on the order of a few seconds or less. The most important disadvantage is that the wash liquid together with the impurities or valuables in the mother liquor are conveyed out with the cake. This limits the use of solid bowls in cake washing.

FIG. 1A shows a conventional solid bowl 10 with a single beach 12 provided with spray nozzles 14 for washing of the cake 16 after the cake comes out of an annular pool 18. The washing and dewatering time is extremely limited. Also, wash liquid and displaced mother liquor may both get conveyed with the cake to discharge 20, rendering washing ineffective.

FIG. 1B shows an improvement, not believed to exist in the art, wherein washing via nozzles 14 takes place in a second beach section 22 of a compound beach 24 in which the second beach section has a shallower angle $\beta_2$ than the angle $\beta_1$ of a first beach section 26. Cake 16 is pushed by a helical conveyor blade 28 along a helical cake flow path of generally decreasing radius. Retention time is increased. Still, wash liquid containing either valuable product or impurities may be carried with the cake 16 to discharge 20 as the surface velocity of the cake is oriented downstream and the component of centrifugal gravity directed upstream along the cake flow path, which is responsible for returning the liquid back to the pool 18, is reduced because of the reduced beach angle and climb angle.

SUMMARY OF THE INVENTION

The present invention provides an improved centrifuge and an associated centrifuge method, as well as a baffle plate for use in the centrifuge and the method. The centrifuge comprises a conveyor for moving cake along a cake flow path towards a cake discharge opening and further comprises a baffle mounted to the conveyor and disposed along the cake flow path. The baffle is provided on an upstream side, facing substantially away from the discharge opening, with a concave profile or surface. This concave profile or surface serves to direct a portion of the cake, which is headed downstream along the cake flow path, into a recirculation or churning path directed partly back towards a pool. The recirculation or churning of the particulate material facilitates an enhanced washing thereof and improves the removal of valuable resins or crystals or impurities from the cake.

The centrifuge includes a bowl having an inner surface, while the conveyor generally includes a hub and, in a principal embodiment of the present invention, is provided downstream of the baffle with a gate extending radially outwardly from the hub. The gate permits only relatively dry cake to pass to the discharge opening. In this design, the baffle takes the form of a churning vane spaced from the hub to define a first gap therewith and spaced from the inner surface of the bowl to define a second gap therewith. Relatively dry cake passes through the second gap towards the cake discharge opening while relatively wet cake is returned upstream. Some of this wetter cake may pass through the first gap, between the churning vane and the hub of the conveyor. Accordingly, it is generally contemplated that the cake, at least in a downstream portion of the beach area, has a radial extent greater than the radial dimension of the baffle or churning vane.

Where the conveyor includes a plurality of blade flights attached to the hub, the baffle or churning vane extends between adjacent blade flights of the conveyor and is oriented substantially perpendicularly to the cake flow path. In accordance with a specific feature the present invention, the baffle or churning vane includes an extension oriented parallel to and along one of the adjacent blade flights. The extension is provided with a concave surface facing the other one of the adjacent blade flights. The extension thus enhances churning by providing another component to the velocity of the wet cake.

In accordance with another feature of the present invention, the baffle or churning vane is provided on a downstream side with a concave profile or surface. This structure facilitates a redirection, back in a downstream direction, of relatively wet cake returning towards a slurry pool at the upstream end of the centrifuge.

The present invention pertaining to the churning and recirculating of cake to enhance washing thereof can be used in a solid bowl or a screen bowl.

In accordance with a further feature of the present invention, spray nozzles are disposed upstream of the baffle for delivering a wash liquid to particulate material of the cake. Wash liquid or spray is preferably supplied to the recirculating cake at an upstream end of a relatively flat section of a compound beach.

Pursuant to an alternative embodiment of the present invention, the baffle is a gate which extends outwardly from the hub of the centrifuge conveyor and is spaced from the inner surface of the centrifuge bowl. This gate may be an exit gate at the cake discharge end of the centrifuge. Alternatively, the baffle or gate may be significantly spaced in an upstream direction from the cake discharge.

In a preferred embodiment of the present invention, the baffle is one of a plurality of baffles all having a concave profile or surface on an upstream side, the baffles being spaced from one another along the cake flow path.

A method of operating a centrifuge comprises, in accordance with the present invention, (a) conveying particulate material along a cake flow path from a pool towards a cake discharge opening and (b) inducing at least a portion of the particulate material traveling along the cake flow path to return partway towards the pool and travel along a loop-shaped recirculation path in a churning process. This recirculation path is necessarily located in a beach section of the centrifuge. The recirculated particulate material does not return to the pool but instead is eventually redirected back to the cake flow path.

It is contemplated that inducing a return of particulate material partway to the pool is implemented by guiding the particulate material along a curved surface of a baffle extending across the cake flow path.

In accordance with an additional feature of the present invention, the loop-shaped recirculation path is one of a series of recirculation or churning loops, while the method further comprises deflecting particulate material from the cake flow path into the series of recirculation or churning loops.

Preferably, the method includes introducing a wash liquid, e.g., by spray-washing or flood-washing, to particulate material of the cake in the loop-shaped recirculation path.

A baffle for a centrifuge comprises, pursuant to the present invention, a baffle in the form of a plate having a pair of opposed major faces, one of the faces being an upstream face and the other of the faces being a downstream face, the upstream face having a concave profile or surface.

The downstream face may also be provided with a concave profile or surface. The baffle is optionally provided with an extension oriented at a substantial angle to the plate, the extension being provided with a concave profile or surface on a side contiguous with the upstream face. Generally, the profile or surface is substantially cylindrical.

Unlike conventional designs, a centrifuge in accordance with the present invention can operate at moderate to high differential speeds, thereby achieving a high solids throughput while maintaining a high cake purity or good recovery of the valuable mother liquor in the wash liquid. The invention is valuable for washing and dewatering of fine particle slurries such as found in fine chemical and pigment processing.

DESCRIPTION OF THE PREFERRED EMBODIMENTS

Figure 1A:
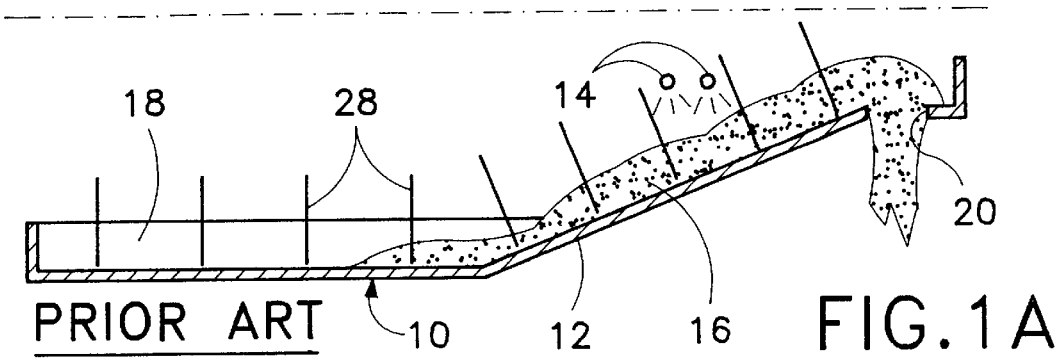
FIG. 1A is a schematic partial longitudinal cross-sectional view of a solid-bowl decanter centrifuge according to the prior art.
Figure 1B:
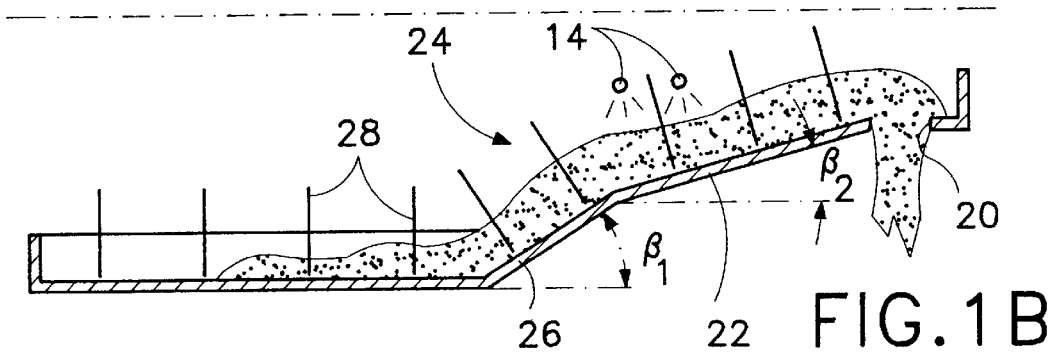
FIG. 1B is a schematic partial longitudinal cross-sectional view of compound-beach centrifuge, not believed to exist in the prior art.
Figure 2A:
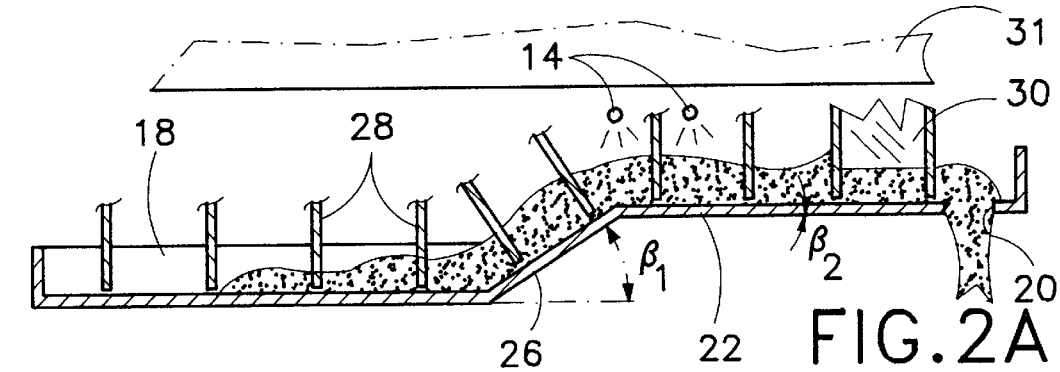
FIG. 2A is a schematic partial longitudinal cross-sectional view of a compound-beach centrifuge with a cake-flow control gate, in accordance with the present invention.

FIG. 2A illustrates an improvement in the centrifuge of FIG. 1B and utilizes some of the same reference numerals. As discussed above with reference to FIG. 1B, washing via nozzles 14 takes place in a second beach section 22 of a compound beach 24 in which the second beach section has a shallower angle $\beta_2$ than the angle $\beta_1$ of a first beach section 26. In the improved embodiment of FIG. 2A, the second angle $\beta_2$ of the compound beach is zero or even negative, i.e., the diameter of the discharge increases to form a shallow conical beach opening towards cake discharge. (This construction requires special assembly. The advantage is torque reduction.) Cake 16 is pushed by a helical conveyor blade 28 along a helical cake flow path from a pool 18 to a cake discharge 20. In this design, an exit gate 30 is installed so as to stop cake from flowing out towards discharge 20. The restriction of cake flow results in a deeper cake height upstream. After the cake has reached a certain thickness, the surface of the cake can flow backward towards the pool 18, carrying displaced mother liquor and wash liquid together with product or impurities.

The provision of exit gate 30 in the improved compound beach design of FIG. 2A further increases cake retention time relative to a compound beach without an exit gate (FIG. 1B). In addition, because the cake assumes a more uniform distribution on the section beach section 22, washing the cake via nozzles 14 can be more effective to displace mother liquor. Generally, spray nozzles 14 should be located along the second beach section 22 at a position spaced from exit gate 30. Nozzles 14 are connected to a conveyor hub 31 which also carries conveyor blade 28 and exit gate 30.

As discussed in detail hereinafter, for instance, with reference to FIGS. 2B and 3, exit gate 30 may be formed on an upstream side (facing pool 18) with a concave profile or surface for causing or enhancing a recirculation or churning of cake solids. Also, as discussed hereinafter, beach 22 (and possibly section 26) may be formed as a screen or as alternating solid-wall sections and screen sections.

Figure 2B:
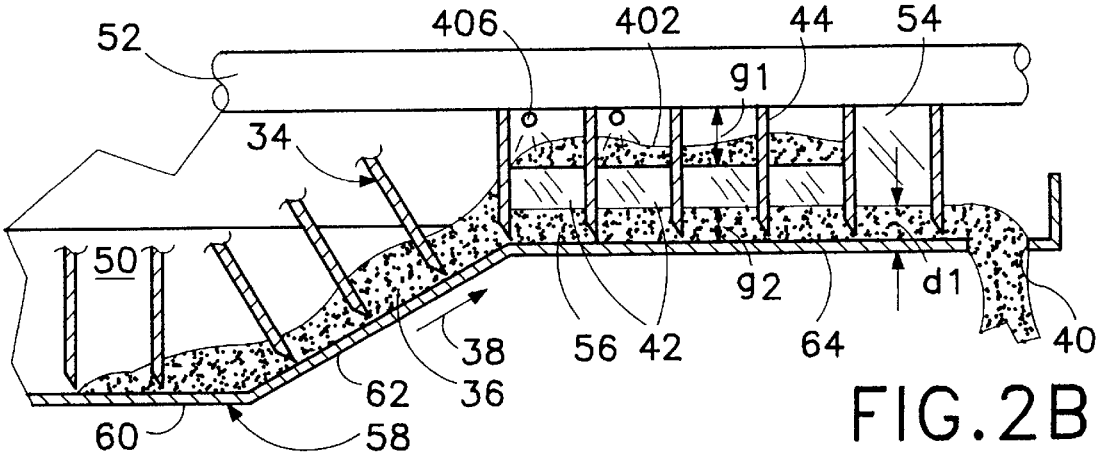
FIG. 2B is a schematic partial longitudinal cross-sectional view of a compound-beach centrifuge with a cake-flow control gate and a plurality of baffles or cake churning vanes in accordance with the present invention.
Figure 3:
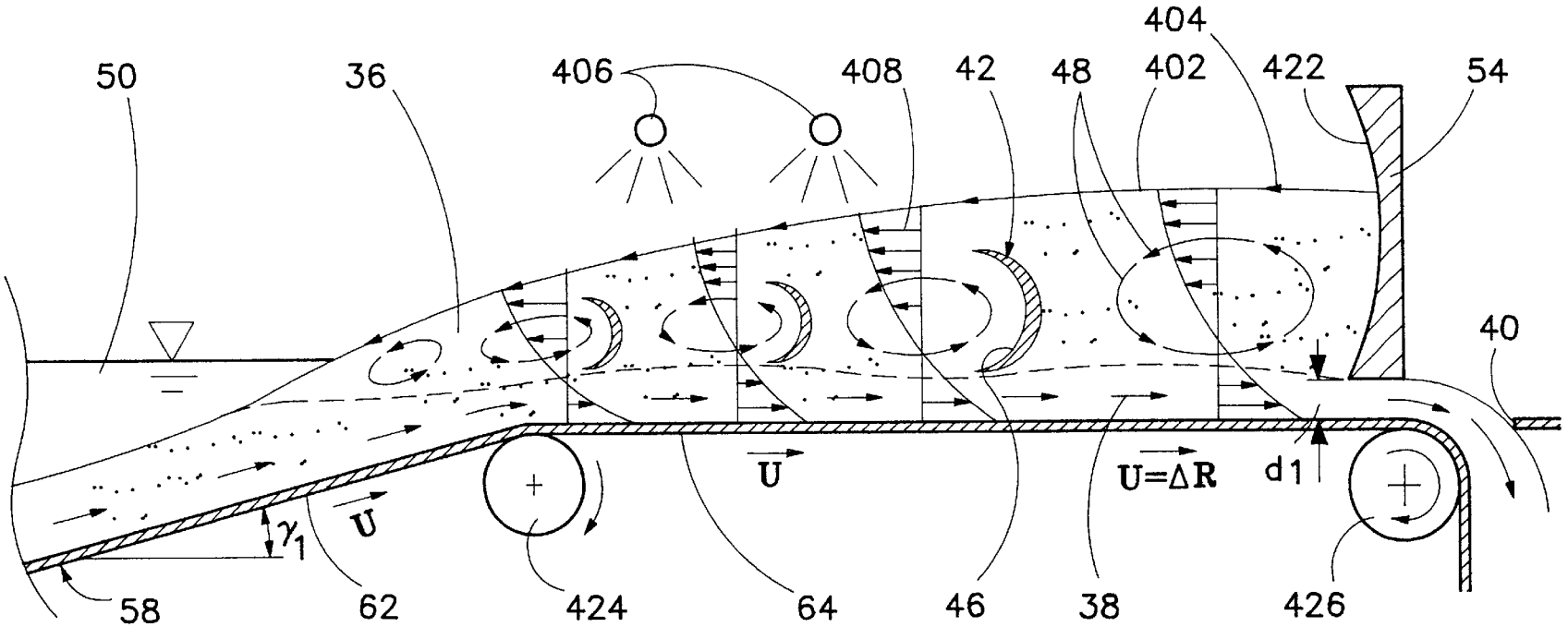
FIG. 3 is a diagram illustrating the mechanics of cake flow in the centrifuge of FIG. 2B by analogy to a moving belt.

As illustrated in FIGS. 2B and 3, a centrifuge comprises a conveyor 34 for moving cake 36 along a generally helical cake flow path (represented by cake velocity arrows 38) towards a cake discharge opening 40 and further comprises a series of baffles or cake churning vanes 42. Baffles or vanes 42 are mounted to one or more wraps or blades 44 of conveyor 34 and are spaced from one another along cake flow path 38.

Baffles or vanes 42 are provided on respective upstream side, facing substantially away from discharge opening 40, with a substantially cylindrical concave profile or surface 46 (FIG. 3). This concave profile or surface 46 serves to direct a portion of cake 36, which is headed downstream along cake flow path 38, into a respective looped recirculation or churning path, indicated by arrows 48, directed partly back towards a slurry pool 50. The recirculation or churning of the particulate material induces additional shear and restructuring of the cake matrix. This facilitates an enhanced washing thereof and improves the removal of valuable resins or crystals or impurities from cake 36.

Conveyor 34 includes a hub 52 and is provided downstream of baffles or vanes 42 with a preferably adjustable gate 54 extending radially outwardly from hub 52. Gate 54 permits only relatively dry cake 36 to pass to discharge opening 40. Gate 54 is spaced an adjustable distance d1 from an inner surface 56 of a centrifuge bowl 58. Bowl 58 includes a cylindrical pool section 60, a conical first beach section 62 and a cylindrical second beach section 64. As illustrated in FIG. 2B, beach section 64 is solid bowl portion. However, as will be apparent from the drawings and descriptions herein, beach section 64 may alternatively take the form of a screen or a series of alternating screens and solid walls.

Baffles or churning vanes 42 are each spaced from hub 52 to define a first gap g1. The baffles or vanes are spaced from inner bowl surface 56 to define a second gap g2. Relatively dry cake 36 passes through gap g2 along cake flow path 38 towards cake discharge opening 36 while relatively wet cake is returned upstream along recirculation loops or paths 48. Some of this wetter cake may pass through one or more gaps g1, between baffles or churning vanes 42 and conveyor hub 52. Cake 36, at least in a downstream portion of beach section 64, has a radial extent greater than a radial dimension of baffles or churning vanes 42 (FIG. 2B).

FIG. 3 shows the mechanics of cake flow in the frame of rotating conveyor 34. FIG. 3 analogizes to a belt (with imaginary rollers 424 and 426) moving at a linear speed $U=\Delta R$ where $\Delta$ is the differential speed between conveyor 34 and bowl 58 and R is the radius of the bowl. A first slope $\gamma_1$ corresponds to the incline along the climb angle and a second slope $\gamma_2$ corresponds to a climb angle of zero. Exit gate 54 causes a large recirculation upstream of the exit gate. The wetter cake is returned along a radially inner free surface 402 in the upstream direction, as indicated by arrowheads 404, while the drier cake containing fewer impurities flows unimpeded downstream towards discharge opening 40. Within this large recirculation motion, in seriatim recirculation loops or paths 48 arise by virtue of baffles or churning vanes 42. The cake retention time can be increased by an order of magnitude as compared to a conventional decanter as shown in FIG. 1A. Washing via spray nozzles 406 takes place at the beginning of the zero-degree beach section 64, i.e., at the upstream end thereof. Baffles or churning vanes 42 also introduce shear stress to the cake, thereby disrupting the cake structure and releasing mother liquor trapped in the fine capillaries associated with fine particles. Moreover, where the drier cake is forced to pass through gaps g2 and wetter cake overflows through gaps g1 above the baffles or vanes 42, the cake profile is rectangular, with a uniform cake height, instead of triangular as exists for granular cake. This allows the wash liquid to effectively displace the mother liquor in the cake without short circuiting, which is common for cake with non-uniform thickness as found in conventional solid bowl, screen bowl and screen scroll. Furthermore, the continuous churning or rearrangement of cake structure is believed to provide a more effective way of releasing cake impurities or resin/crystal product which is subsequently carried by the wash liquid back to slurry pool 50.

FIG. 3 also depicts at 408 the velocity profiles of the cake in a series of radial planes associated with respective recirculation loops or paths 48.

Cake 36 is released through exit gate 54, which is radially adjustable to vary distance d1. The adjustability of gate 54 allows for control of cake retention time and therefore cake purity and dryness. Unlike conventional designs, a centrifuge as described herein can operate at moderate to high differential speeds, thereby achieving a high solids throughput while maintaining a high cake purity or good recovery of the valuable mother liquor in the wash liquid.

Figure 4A:
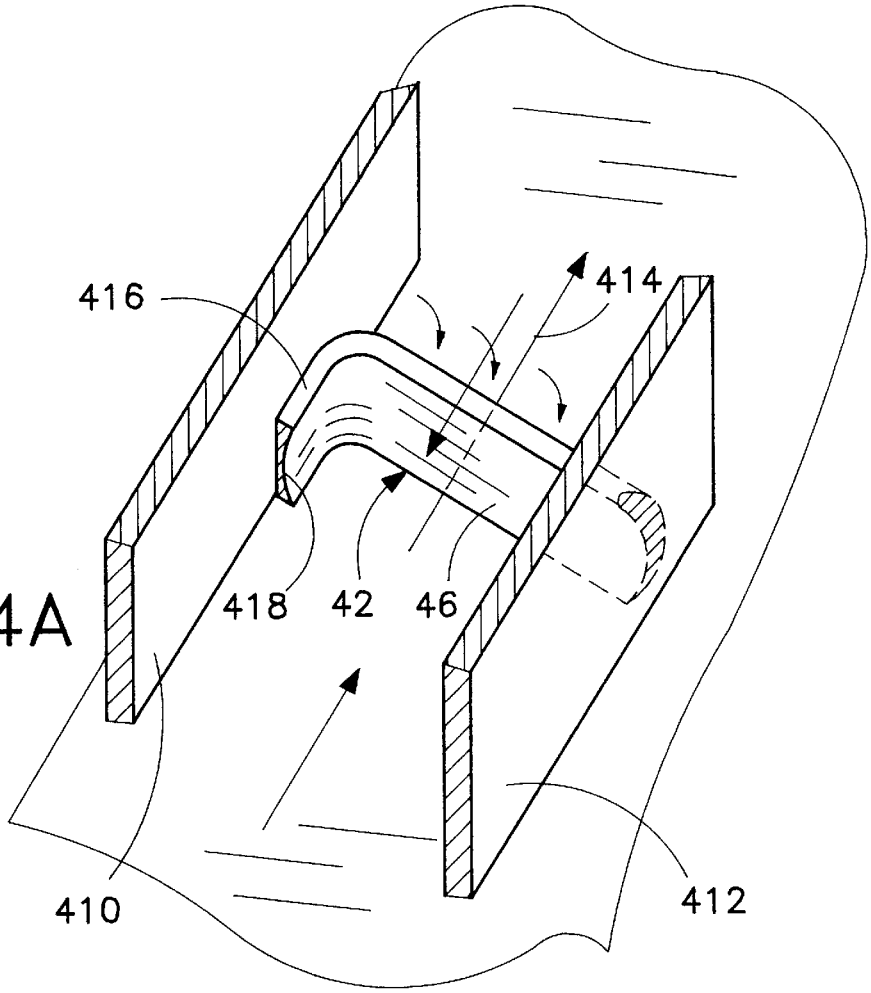
FIG. 4A is a schematic perspective view of a baffle or cake churning vane in accordance with the present invention.
Figure 4B:
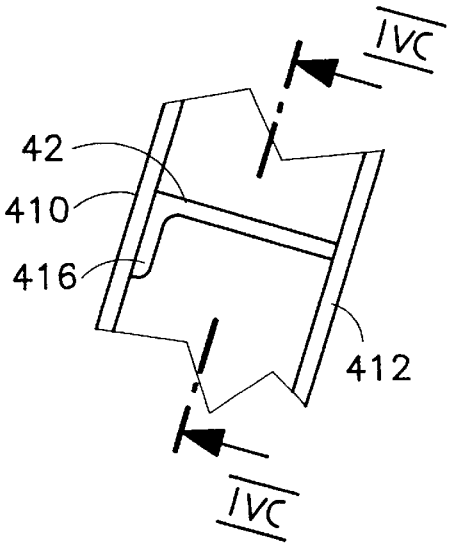
FIG. 4B is a schematic top plan view of the baffle or cake churning vane of FIG. 4A.
Figure 4C:
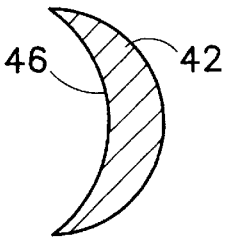
FIG. 4C is a cross-sectional view taken along line IVC—IVC in FIG. 4B.

FIGS. 4A–4C illustrate a representative baffle or churning vane 42 in greater detail than in FIGS. 2B and 3. Where conveyor 34 includes a plurality of blade flights attached to hub 52, the baffle plate or churning vane extends between adjacent blade flights 410 and 412 of the conveyor and is oriented substantially perpendicularly to the direction of cake flow, indicated by an arrow 414. To enhance churning, baffle or vane 42 includes an extension 416 oriented parallel to and along blade flight 410. Extension 416 is provided with a concave surface 418 facing blade flight 412. Extension 416 thus enhances churning by providing another component to the velocity of the relatively wet cake.

Figure 4D:
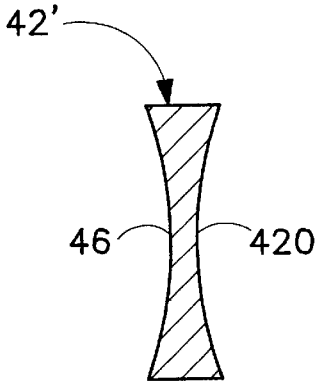
FIG. 4D is a cross-sectional view similar to FIG. 4C, showing an alternative design.

As depicted in FIG. 4D, one or more baffles or churning vanes 42' may be provided on a downstream side with a concave profile or surface 420. This additional concave surface 420 enhances the cake churning action by facilitating a redirection, back in a downstream direction, of relatively wet cake traveling towards slurry pool 50. In other words, concave surfaces 420 facilitate or enhance the establishment of recirculation loops or paths 48.

As illustrated in FIG. 3, gate 54 is provided on an upstream side with a concave profile or surface 422. Gate 54 thus acts as a baffle in inducing a recirculation or churning of cake 36.

A method of operating a centrifuge includes (a) conveying particulate material or cake 36 along cake flow path 38 from pool 50 towards cake discharge opening 40 and (b) inducing at least a portion of the particulate material or cake 36 traveling along cake flow path 38 to return partway towards pool 50 and travel along a loop-shaped recirculation path 48 in a churning process. This recirculation path 48 is necessarily located in a beach section, preferably 64, of the centrifuge. Recirculated particulate material or cake 36 does not return to pool 50 but instead is eventually redirected back to cake flow path 38. Inducing a return of particulate material or cake 36 partway to pool 50 is implemented by guiding the particulate material along curved surface 46 of a baffle 42 extending across cake flow path 38.

Although the foregoing discussion was directed to the use of baffles or churning vanes 42 in a solid-bowl decanter centrifuge, these baffles or churning vanes also serve the same useful function in a screen bowl or pusher centrifuge. Some improved screen bowl or pusher centrifuges where such baffles or churning vanes may be advantageously used are described below.

Figure 5:
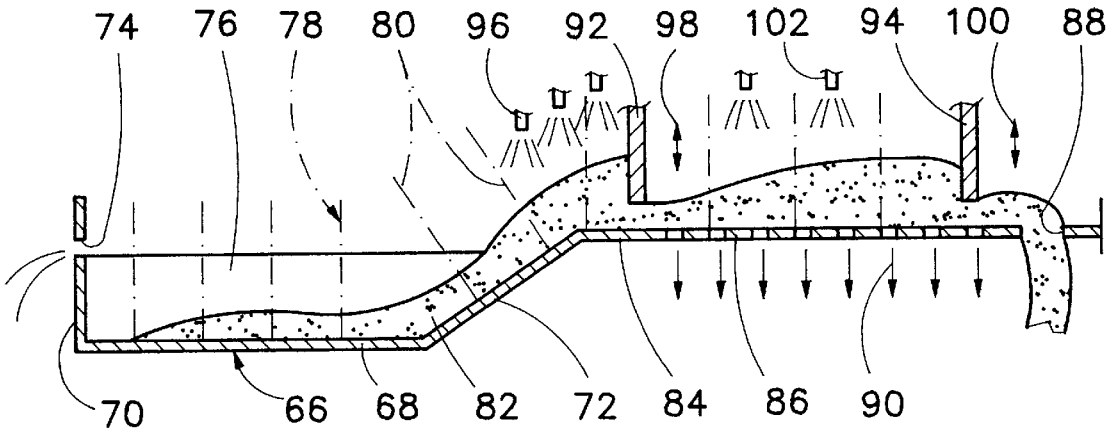
FIG. 5 is a schematic longitudinal cross-sectional view of a screenbowl centrifuge in accordance with the present invention.

As diagrammatically illustrated in FIG. 5, a screenbowl centrifuge includes a bowl 66 with a cylindrical section 68 connected on one side to a transverse wall 70 and on an opposite side to a conical beach 72. Transverse wall 70 is provided with a liquid discharge opening 74 having a radial location which defines the depth of a clarifier or separation pool 76. A conveyor 78 having one or more helical screw wraps 80 rotates at a slightly different velocity from that of bowl 66 to push particulate material or cake 82 from pool 76 and along beach 72 to a smaller-diameter cylindrical bowl section 84 disposed on a side of beach 72 opposite to pool 76 and cylindrical section 68. During the negotiation of beach 72, the particulate material or cake 82 is dewatered, with excess fluid flowing back into pool 76.

In response to the differential speed of conveyor 78 relative to bowl 66, cake 82 is pushed along cylindrical bowl section 84 and over a cylindrical screen section 86 to a cake discharge port at 88. During its passage over screen section 86, cake 82 is dewatered owing to desaturation, i.e., the ejection of liquid through screen section 86, as indicated by arrows 90.

Screen section 86 is flanked on an upstream side by an inlet gate 92 and on a downstream side by an outlet gate 94, as determined by the direction of cake flow. Gate 92 cofunctions with the differential speed of conveyor 78 relative to bowl 66 to control the amount of cake released to screen section 86, while gate 94 cofunctions with the differential speed of conveyor 78 relative to bowl 66 to control the retention time of the cake on the screen and the rate of cake discharge through port 88. It is to be noted here that cylindrical bowl section 84 extends past gate 92, for preventing the discharge of fine particulate matter through screen section 86.

Upstream of gate 92, flood wash feed nozzles 96 are provided for reslurrying the particulate material or cake 82 after the initial dewatering and prior to further dewatering in the screen area of the bowl. This flood wash fluidizes cake 82 and also serves to enhance and displace the contaminated mother liquor, which flows back down into clarifier pool 76. Accordingly, the cake conveyed downstream past gate 92 to screen section 86 has a reduced impurities content. Gate 92 permits only the cake layer adjacent to cylindrical bowl section 84 to pass to the subsequent dewatering stage. This cake layer is the driest.

Exit or outlet gate 94 controls the cake profile at the outlet end of screen section 86 and also controls the residence time of the cake on screen section 86 so as to maximize the dewatering of the cake on screen section 86. Gates 92 and 94 separate centrifuge bowl 66 into two compartments. In the first compartment, upstream of gate 92, dewatering of cake 82 occurs on beach 72 and reslurrying takes place on cylindrical bowl section 84. In the section compartment, between gates 92 and 94, dewatering is effectuated via screen section 86.

It is to be noted that gates 92 and 94, as well as similar gates disclosed hereinafter, are radially adjustable, as indicated by arrows 98 and 100. It is contemplated that the radial positions of gates 92 and 94 are adjustable from outside the machine without requiring a dismantling thereof. Various mechanisms for implementing such adjustability are disclosed in U.S. Pat. No. 5,643,169, the disclosure of which is hereby incorporated by reference.

The dewatering compartment defined by screen section 86 and gates 92 and 94 is optionally provided with spray nozzles 102. The spray wash provided by nozzles 102 is more effective than conventional spray washes insofar as the cake over screen section 86 is more uniformly distributed than in conventional centrifuges owing to the leveling effect of gate 92.

Furthermore, gates 92 and 94 can assume profiles similar to those illustrated in FIGS. 4C and 4D to enhance churning of the cake to set up a large recirculation flow loop to enhance cake washing.

Figure 6:
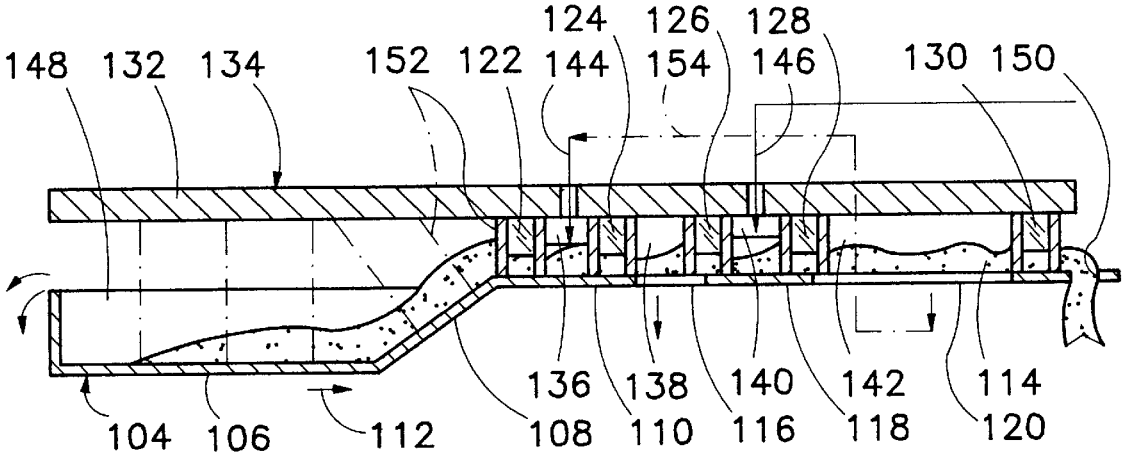
FIG. 6 is a schematic longitudinal cross-sectional view of a screenbowl centrifuge which may be provided with a baffle or gate in accordance with the present invention.

As illustrated in FIG. 6, a screenbowl-type decanter centrifuge has a bowl 104 with a first cylindrical solid bowl section 106 connected at one end to a conical beach 108 in turn connected to a second cylindrical solid bowl section 110 to be followed by alternating screen and solid wall sections downstream. Bowl section 110 is contiguous, on a downstream side as determined by a direction 112 of flow of a layer of particulate material or cake 114, with an annular or cylindrical screen section 116. On a downstream side of screen section 116 is provided another cylindrical solid bowl section 118 and then another annular or cylindrical screen section 120. A series of radially adjustable gates, 122, 124, 126, 128, and 130 depending from a hub 132 of a conveyor 134 are positioned generally at the junctions between the successive cylindrical bowl sections 110, 116, 118, and 120 downstream of beach 108 to define therewith a series of compartments 136, 138, 140, and 142. Compartments 136 and 140 are provided with nozzles or passageways 144 and 146 (diagrammatically represented by arrows indicating fluid flow) extending through the conveyor hub for introducing wash liquid into those compartments for purposes of reslurrying cake 114 during its transit along a cake flow path (see direction of flow arrow 112) from a clarifier pool 148 at one end of the centrifuge to a cake discharge opening or openings 150 at an opposite end of the centrifuge.

Conveyor 134 includes one or more screw wraps 152 for pushing cake 114 along the cake flow path identified by cake flow direction 112. As described in detail hereinafter, gates 122, 124, 126, 128, and 130 are contiguous with and movably connected to conveyor wraps 152. Gates 122, 124, 126, 128, and 130 establish entrance and exits openings for the various interleaved compartments 136, 138, 140, and 142 and control cake thickness at the entrance sides of the compartments. As discussed above with reference to FIG. 5, low-flow-rate spray nozzles (not shown) may be provided in dewatering compartments 138 and 142. Gates 124 and 128 force the cake in compartments 138 and 142 to have a uniform thickness, thereby facilitating or enhancing the removal of residual mother liquor through drainage in those compartments. On the other hand, gates 122 and 126 force the cake in compartments 136 and 140 to have a uniformity, thereby facilitating reslurrying of the particulate matter by the wash liquid. The uniform cake thickness allows a better reslurrying as channeling through thinner cake with reduced flow resistance is not possible.

As cake 114 is conveyed along cake flow path 112, it is dewatered first in beach section 108, then reslurried in compartment 136, dewatered or desaturated in compartment 138, reslurried again in compartment 140, and finally dewatered or desaturated again in compartment 142. As indicated by phantom line 154, liquid extracted from cake 114 via screen section 120 may be returned as wash liquid to compartment 136 via nozzle 144 to wash the cake upstream, i.e., in a countercurrent washing with the wash liquid becoming increasingly saturated with impurities as the wash travels upstream while the cake becomes increasingly pure after each wash in traveling downstream towards the cake exit.

It is to be understood that solid bowl sections 110 and 118 may be formed as blinds which are inserted into bowl 104 to overlie spaced cylindrical portions of a single screen at the output end of the machine. This manner of assembly is especially appropriate in retrofits. Of course, solid bowl sections 110 and 118 may be solid cylindrical plates like bowl section 106. It is accordingly clear that the term "solid bowl section" as used herein is meant to denote plate sections of a centrifuge bowl and sections of a screen bowl covered with blinds to render those sections effectively solid for purposes of permitting reslurrying of materials.

In using such a counter-current reslurry/wash, incoming fresh wash liquid is used to flood wash the exiting cake in compartment 140 and, optionally, to spray wash the exiting cake in compartment 142. Filtrate is collected and used to reslurry/wash the cake further upstream. Filtrate obtained from upstream dewatering compartment 138 via screen section 116 is concentrated in impurities and is discarded.

Figure 7:
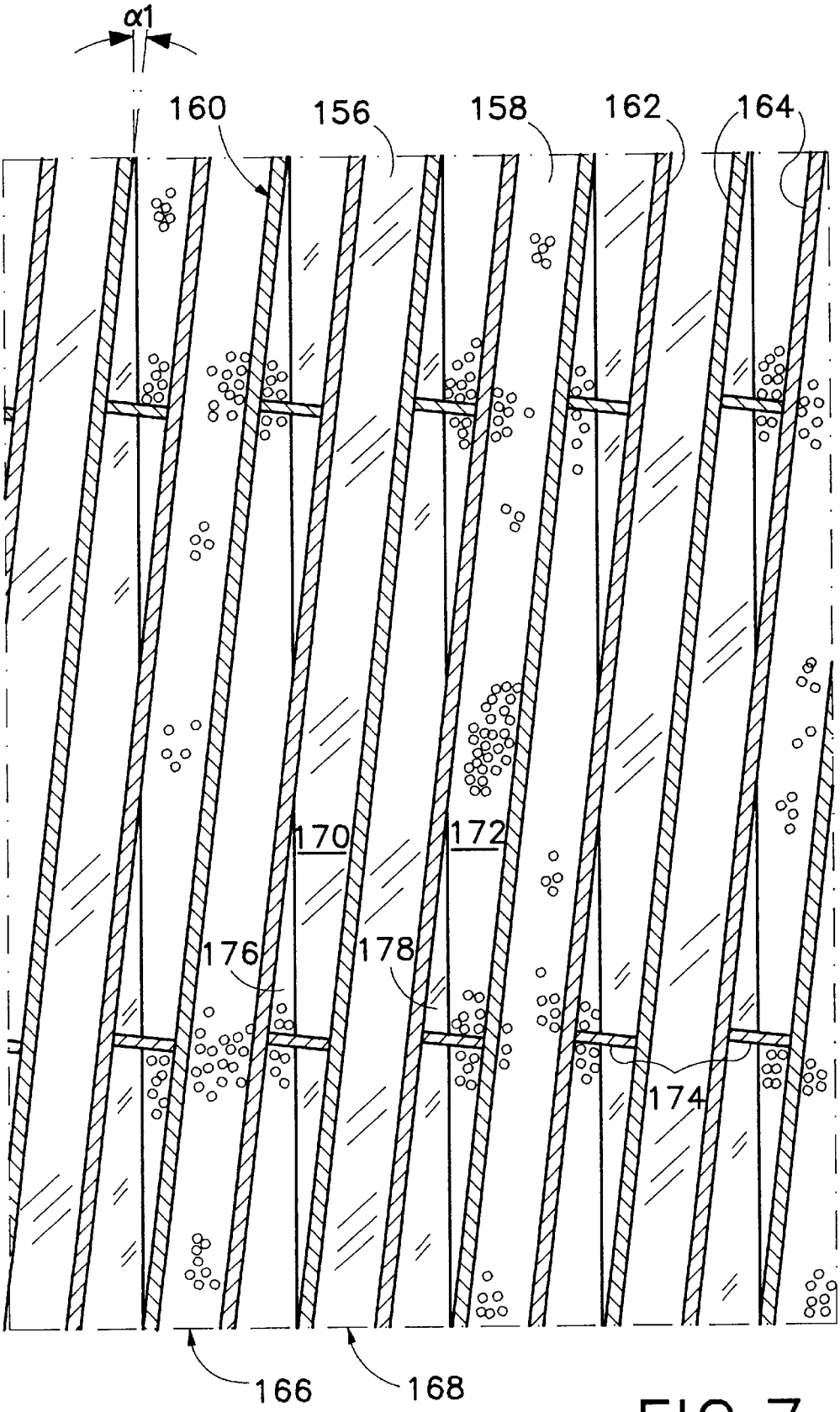
FIG. 7 is a schematic unwrapped or developed view of a screenbowl centrifuge optionally provided with baffles or gates in accordance with the present invention, showing the placement of the baffles or gates relative to alternating cylindrical solid bowl sections and screen sections.

FIG. 7 depicts an unwrapped or developed bowl of a screenbowl centrifuge wherein the bowl is provided in a conical beach and/or a cylindrical bowl wall downstream thereof with a plurality of annular solid bands or circumferentially extending solid bowl sections 156 interleaved in the axial direction with a plurality of annular screen sections or circumferentially extending perforate screen sections 158. A conveyor 160 has a plurality of interleaved screw wraps 162 and 164 extending at an angle a1 relative to the solid bowl sections 156 and the perforate screen sections 158. Screw wraps 162 and 164 define a plurality of helical channels 166 and 168 along which cake flows from a clarifier pool and beach (neither shown) to a cake discharge port (also not shown). Along each channel, plural reslurrying compartments 170 and multiple dewatering compartments 172 alternating with one another in a cake flow direction are defined in part by radially adjustable entrance and exit gates 174 which are contiguous with and extend substantially perpendicularly to wraps 162 and 164. Gates 174, formed as baffle plates, extend outwardly from a centrifuge hub (not shown) and are connected to wraps 162 and 164. Cake flows through the opening formed between the bowl wall and the free edges of the gates.

As shown in FIG. 7, due to the helix geometry, end effects arise which are associated with the entrance and exit of each compartment 170 and 172. These end effects include the disposition of either a triangular perforate wall area 176 in a reslurrying compartment 170 or a solid wall area 178 in a dewatering compartment 172. FIGS. 8, 9, 10 and 11 depict different techniques for eliminating these end effects. In FIGS. 8, 9, 10, and 11, reference numerals from FIG. 7 are used to designate the same structural elements as in FIG. 7.

Figure 8:
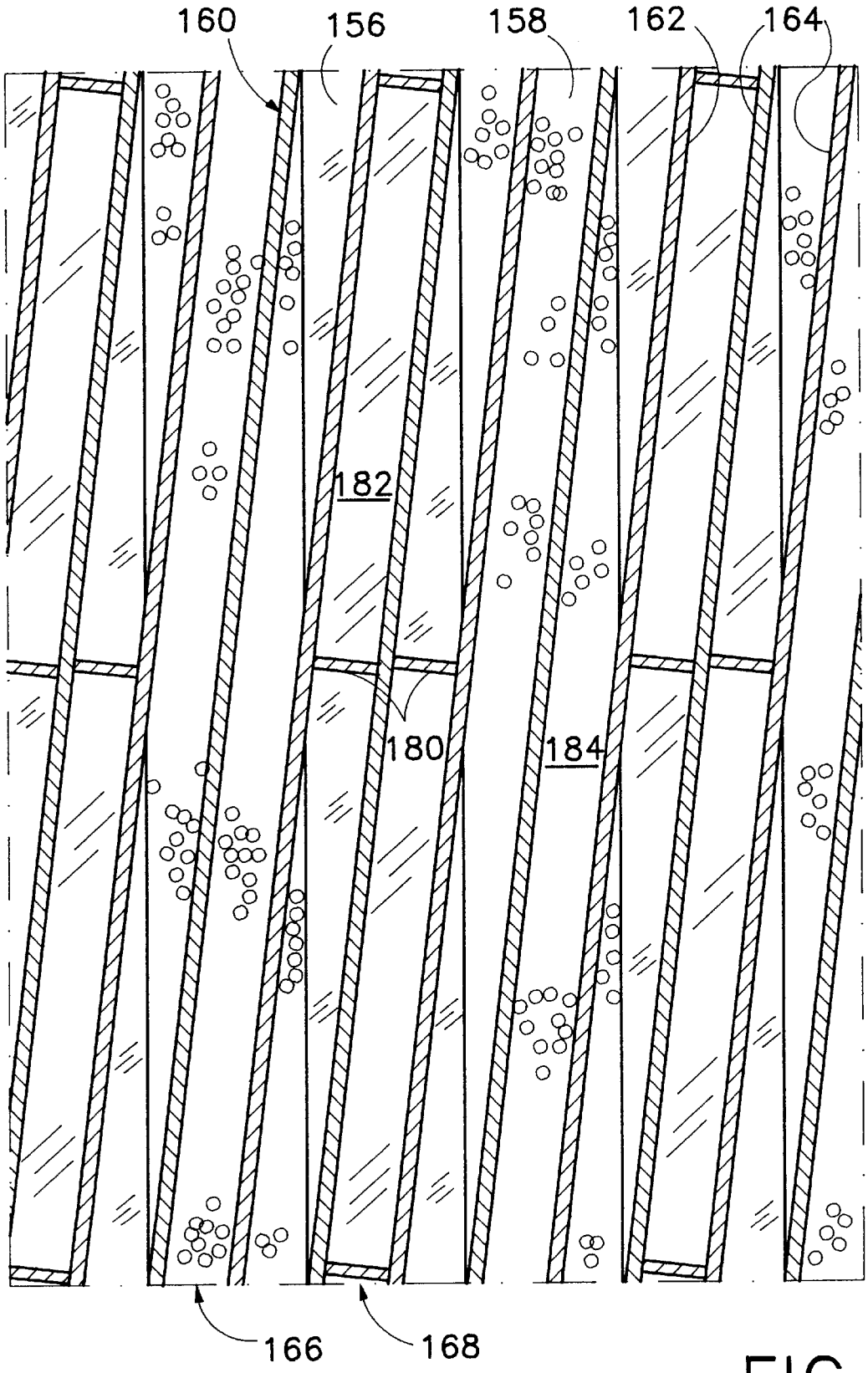
FIG. 8 is a schematic unwrapped or developed view similar to FIG. 7, showing an alternative placement of baffles or gates relative to alternating cylindrical solid bowl sections and screen sections.

As illustrated in FIG. 8, gates 180 are installed which are so located as to form reslurrying compartments 182 having bowl walls which are completely solid. Thus, gates 180 are shifted relative to gates 174 to eliminate triangular perforate areas 176. Reslurrying compartments 182 in the embodiment of FIG. 8 are shorter than reslurrying compartments 170 in FIG. 7. Concomitantly, dewatering compartments 184 in FIG. 8 are longer than dewatering compartments 172 in FIG. 7. In this embodiment of a screenbowl centrifuge, the outer wall of each dewatering compartment 184 has a screen or perforate portion and two triangular solid portions.

Figure 9:
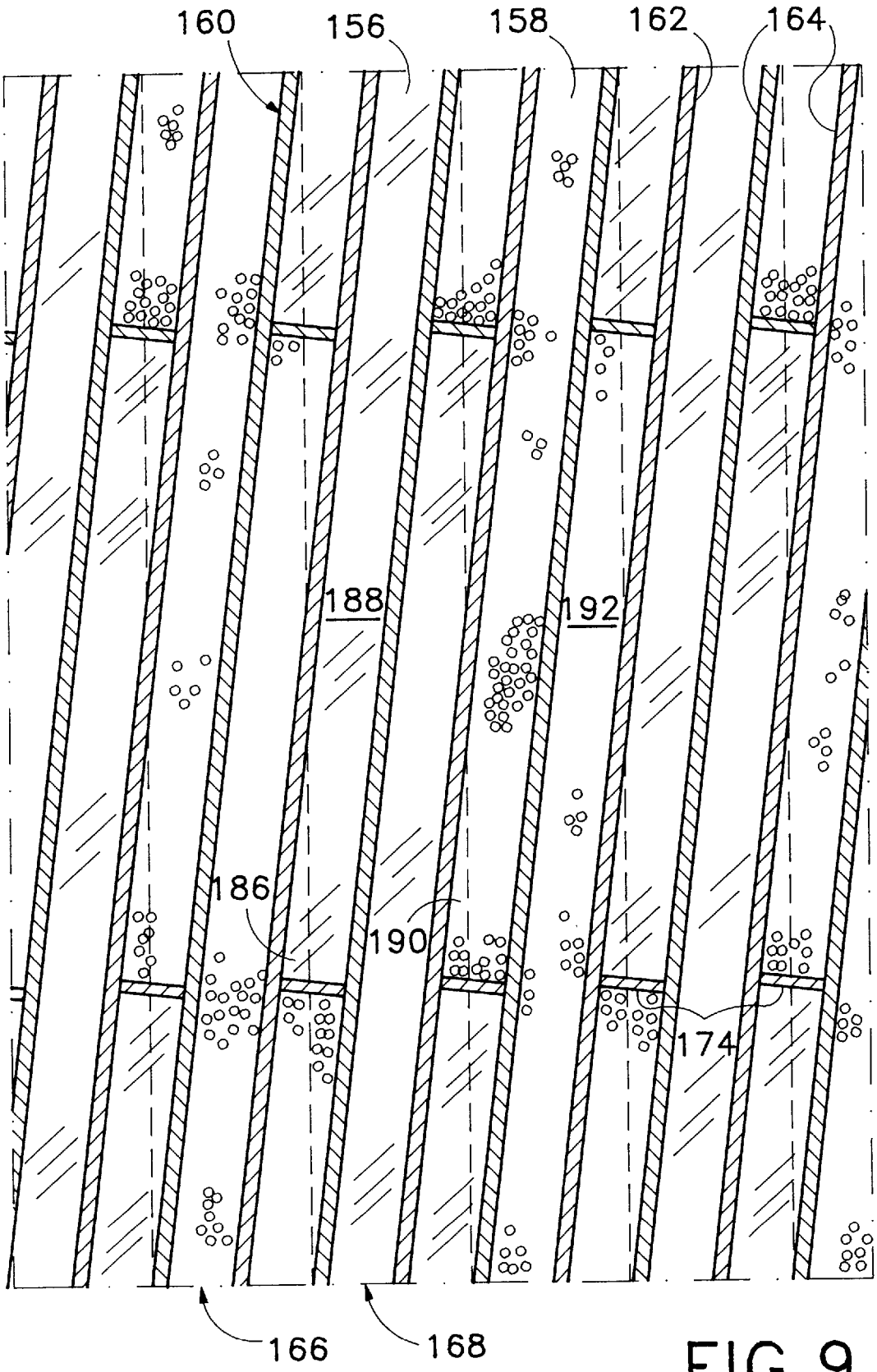
FIG. 9 is a schematic unwrapped or developed view similar to FIG. 7, showing modifications to the cylindrical solid bowl sections and screen sections of FIG. 7.

As shown in FIG. 9, triangular perforate wall areas 172 (FIG. 7) may be replaced with respective triangular solid sections or plates 186, thereby forming reslurrying compartments 188 which have radially outer walls which are completely solid. Similarly, triangular solid areas 178 (FIG. 7) are replaced with triangular perforate sections or screens 190, thereby forming dewatering compartments 192 whose radially outer walls are entirely perforated. Compartments 188 and 192 may have the same length as compartments 170 and 172, respectively.

Figure 10:
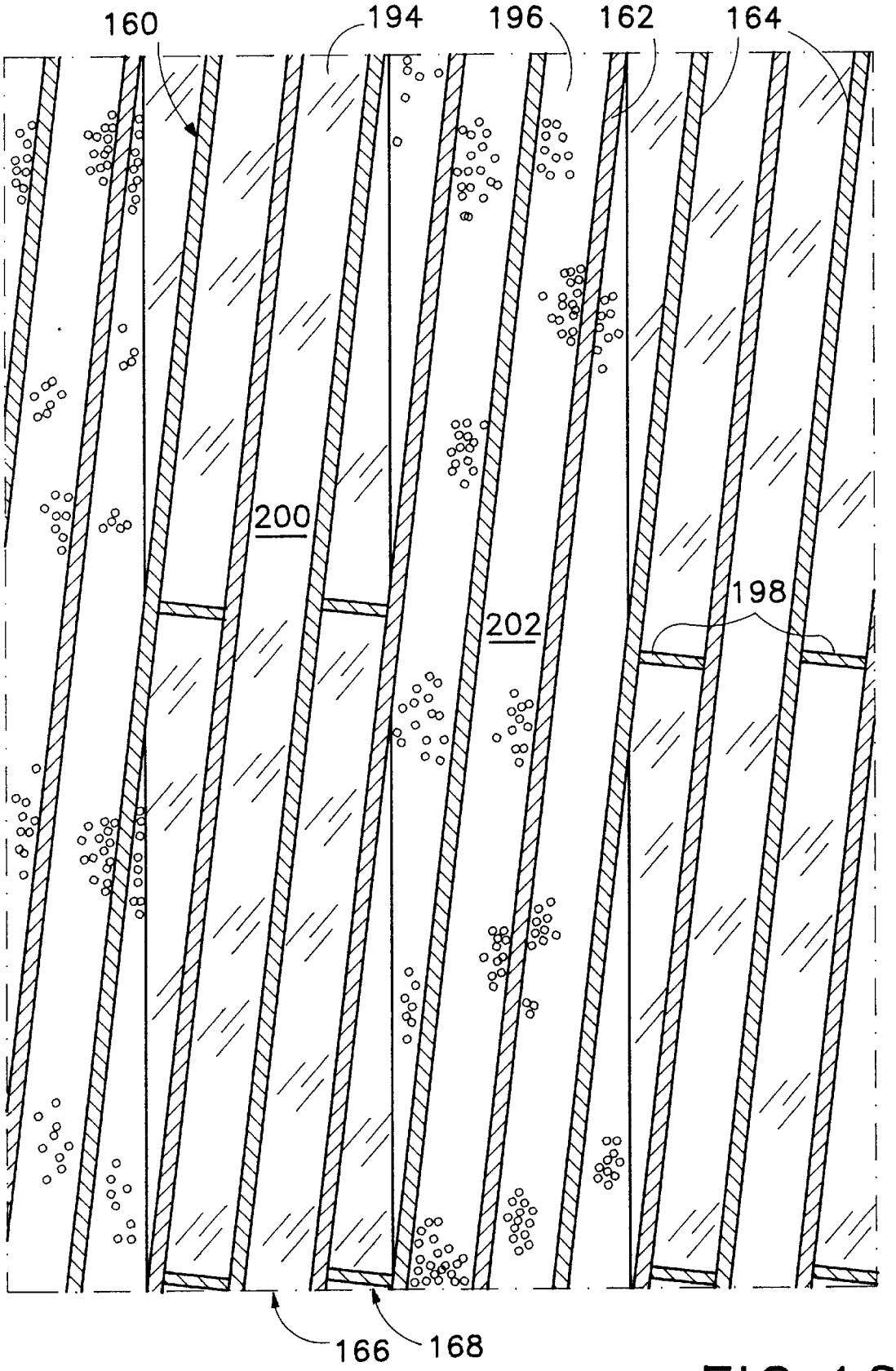
FIG. 10 is a schematic unwrapped or developed view similar to FIG. 7, showing an alternative solid bowl sections and screen sections having a different width relative to a distance between successive conveyor screw flights.

As depicted in FIG. 10, the centrifuge bowl wall can be formed with alternating cylindrical solid sections 194 and cylindrical screen sections 196 which are wider relative to the width of channels 166 and 168, i.e., relative to the separation of adjacent conveyor wraps 162 and 164. The increase in bowl section width together with the placement of gates or baffles 198 produces longer reslurrying compartments 200 and longer dewatering compartments 202, relative to compartments 170 and 172 in FIG. 7. Gates 198 may be placed, as discussed above with reference to FIG. 8, to eliminate vestigial perforate areas in reslurrying compartments 200.

Figure 11:
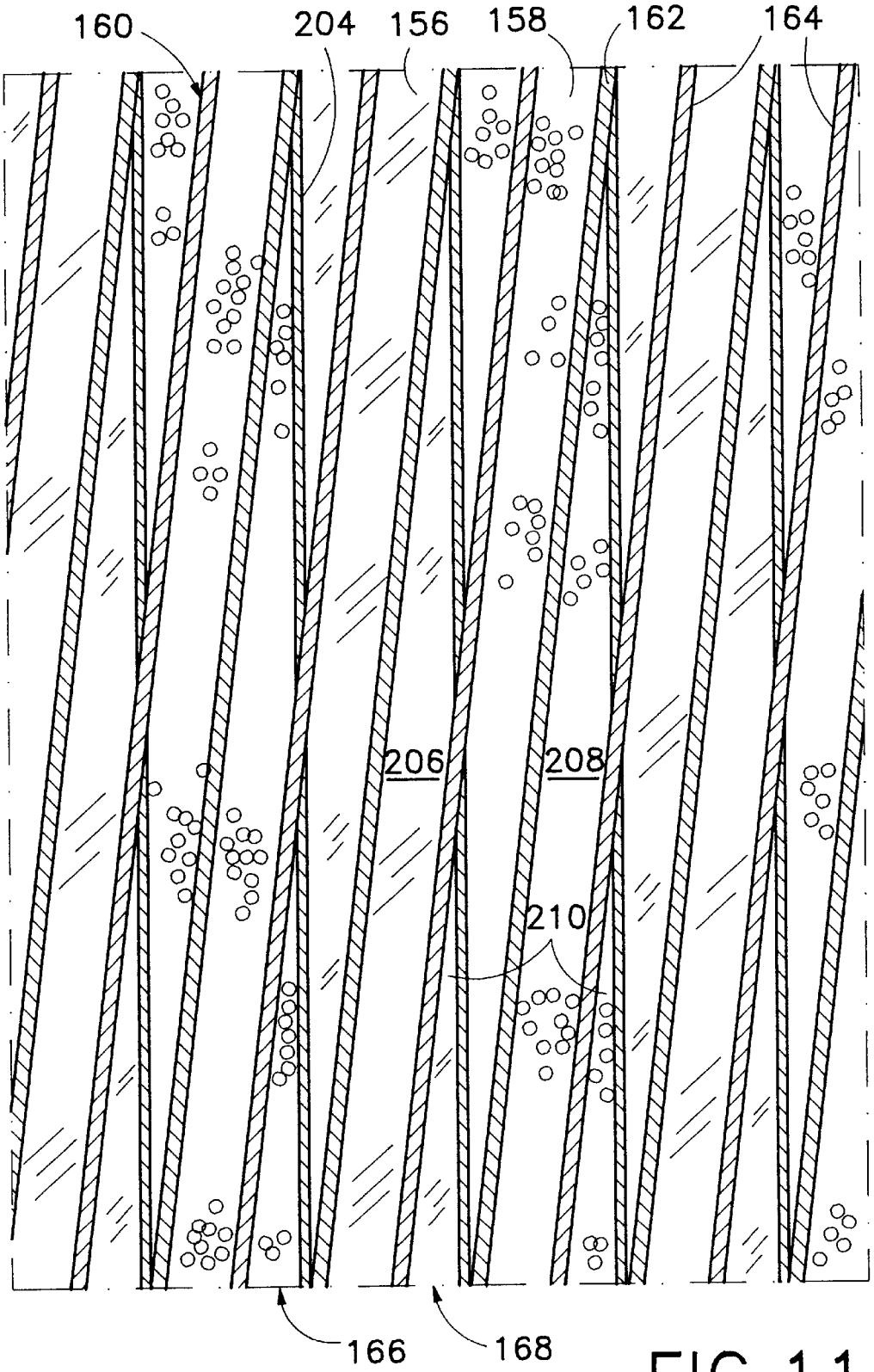
FIG. 11 is a schematic unwrapped or developed view similar to FIG. 7, showing alternative gates extending circumferentially, rather than perpendicularly to conveyor flights.

Another arrangement which eliminates the end effects is the use of circumferential gates or weirs 204 to produce reslurrying and dewatering compartments 206 and 208, as shown in FIG. 11. Unlike with perpendicular gates 174, 180, and 198, the cake in the embodiment of FIG. 11 sees non-uniform resistance as it meets circumferential weirs 204, producing the undesirable consequence of cake jamming in corners 210.

Figure 12:
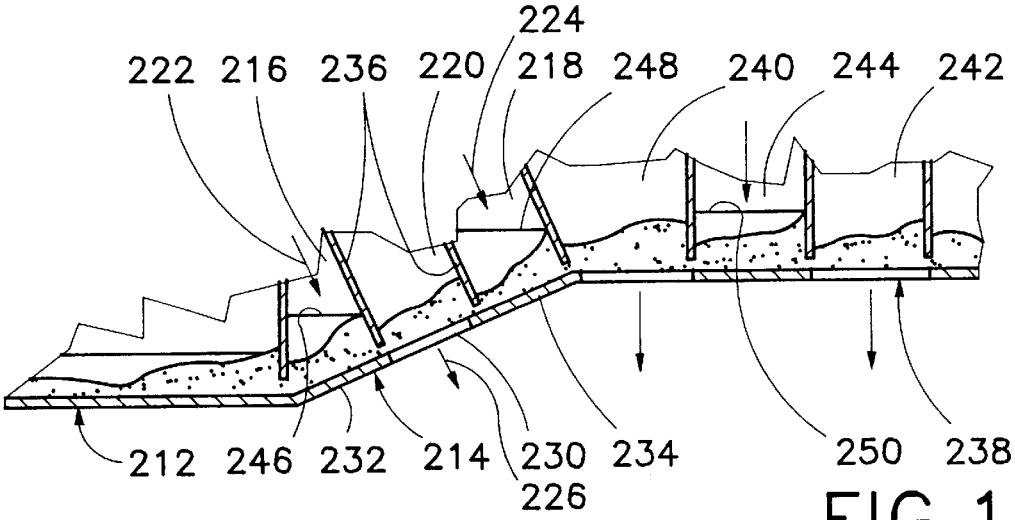
FIG. 12 is a schematic partial longitudinal cross-sectional view of another embodiment of a centrifuge optionally provided with baffles or gates or churning vanes in accordance with the present invention, showing reslurrying and separation in conical and cylindrical bowl sections above an annular separation pool.

As illustrated in FIG. 12, a bowl 212 of a screenbowl centrifuge may be provided along a beach 214 with one or more reslurrying compartments 216 and 218 and one or more dewatering compartments 220 interleaved or alternating with the reslurrying compartments. Flood wash liquid is fed to reslurrying compartments 216 and 218 via nozzles at 222 and 224. Wash liquid and mother liquor, schematically represented by an arrow 226, exits cake 228 via a conical screen section 230 along an outer side of dewatering compartment 220. Screen section 230 is flanked on opposite sides by conical solid bowl sections 232 and 234 defining outer walls of reslurrying compartments 216 and 218. Compartments 216, 218 and 220 are defined in part by gate or baffle elements 236. Bowl 212 may include an output cylinder 238 optionally provided with one or more additional dewatering compartments 240 and 242 and one or more additional reslurrying compartments 244. FIG. 12 diagrammatically represents flood wash reslurrying by showing slurry levels 246, 248, and 250 in reslurrying compartments 216, 218, and 244.

Figure 13:
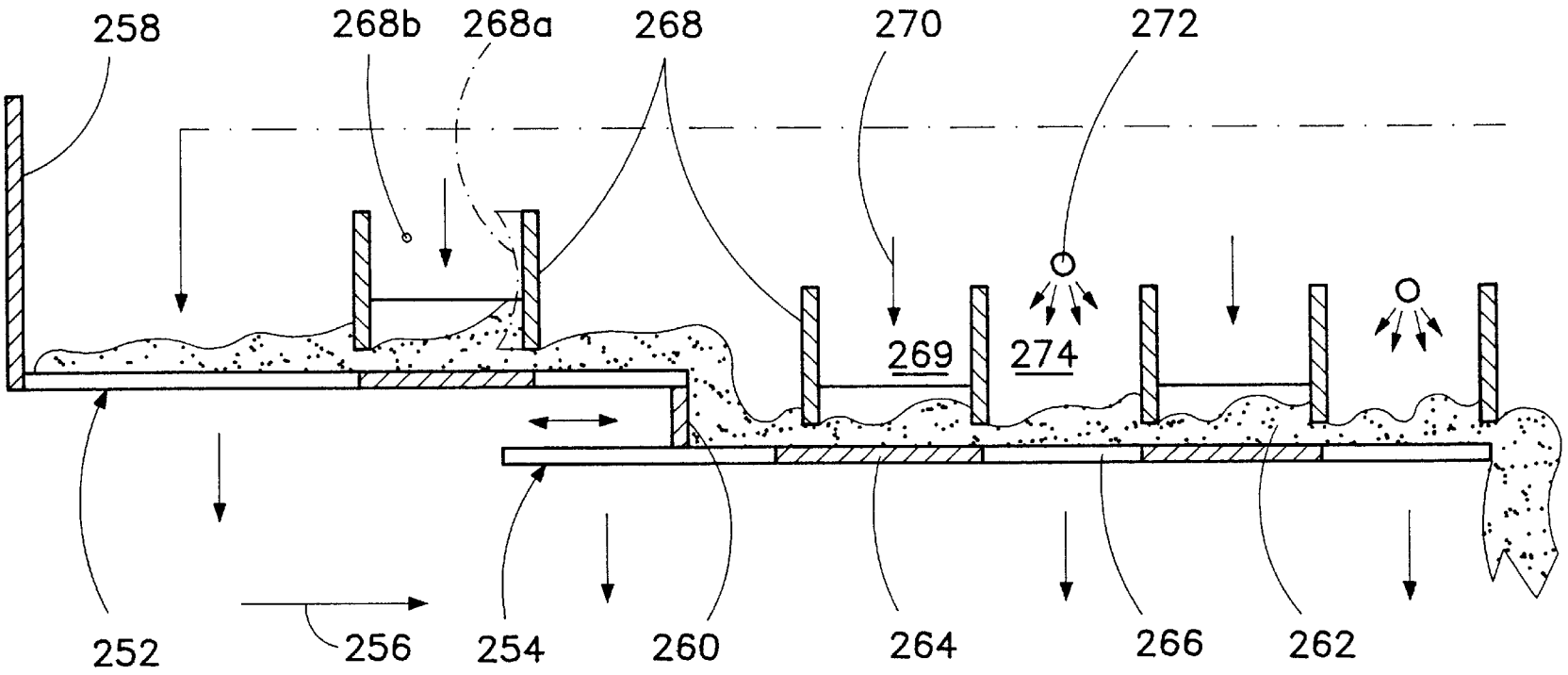
FIG. 13 is a schematic longitudinal cross-sectional view of a two-stage pusher-type centrifuge which may be provided with baffles in accordance with the present invention.

FIG. 13 depicts a pusher-type centrifuge including a cylindrical first basket 252 and a cylindrical second basket 254 disposed downstream of the first basket along a cake flow path 256. Basket 252 has a smaller diameter than basket 254. The centrifuge also includes pushers 258 and 260 for pushing a particulate cake layer 262 along baskets 252 and 254, respectively. Baskets 252 and 254 have a plurality of circumferentially extending solid bowl sections 264 alternating with circumferentially extending perforate screen sections 266, while a plurality of circumferential and radial gates 268 are disposed at junctions between adjacent solid bowl and perforate screen sections 264 and 266. Flood wash liquid is supplied to reslurrying compartments 269 by nozzles, as indicated by arrows 270, while spray nozzles 272 may be provided in dewatering compartments 274 for spraying cake 262 during dewatering or desaturation thereof.

Tests conducted on an 18-in diameter screenbowl show promise of the above-described reslurrying-and-separation design. This is especially suitable for screenbowl operating at high flow rate and low centrifugal gravity. As much as 4–6% washing efficiency improvement can be obtained with the reslurrying-and-separation arrangement as compared to a conventional washing arrangement with a screenbowl despite the open screen area is much reduced.

Multiple reslurrying and separation stages in a single pusher centrifuge may be carried out for single-stage pushers as well as multi-stage pushers, each with a large diameter basket with alternating stages reciprocating, and all the stages also rotating concurrently.

Figure 14:
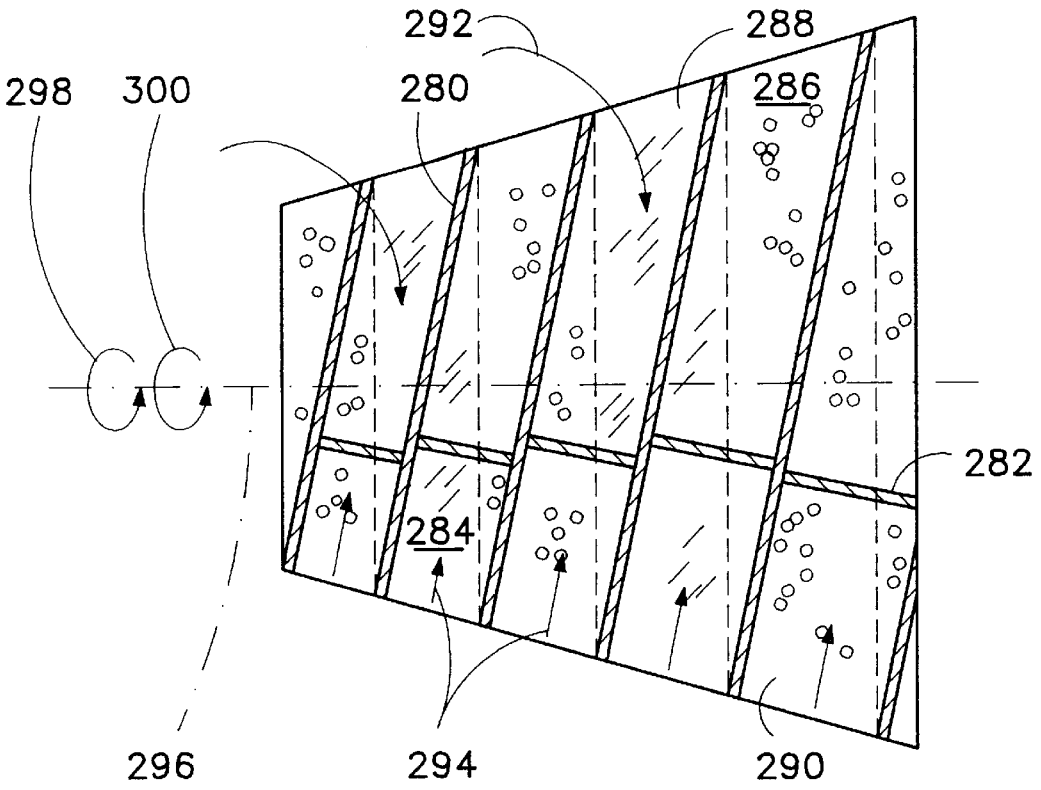
FIG. 14 is a schematic unwrapped or developed view of a conical-screen centrifuge, showing the placement of gates relative to alternating cylindrical imperforate sections and screen sections.

FIG. 14 is an unwrapped or developed view of a conical-screen centrifuge having a single-lead conveyor 280. A series of baffles or gates 282 are provided substantially perpendicular to the conveyor lead or blade for separating the screen area or conical wall of the centrifuge into reslurrying compartments 284 and dewatering compartments 286 alternating therewith. The conical wall of the centrifuge is formed with circumferentially extending solid or imperforate sections or bands 288 interleaved with circumferentially extending perforated screen sections or bands 290. Wash liquid is introduced into the reslurrying compartments, as indicated by arrows 292. Cake moves along a helical path, as indicated by cake flow arrows 294, as the conveyor 280 and the conical centrifuge wall rotate at differential speeds about an axis 296, as indicated by arrows 298 and 300.

The arrangement of FIG. 14 also applies to conical-screen centrifuges with multiple-lead conveyors.

Figure 15:
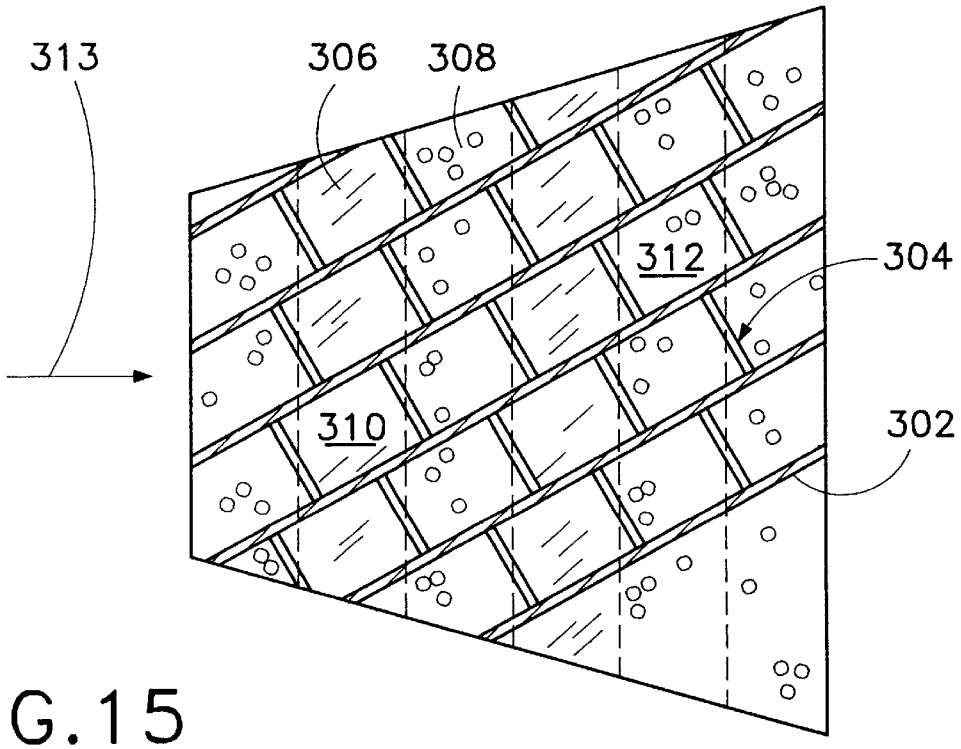
FIG. 15 is a schematic unwrapped or developed view of another conical-screen centrifuge, showing the placement of gates relative to alternating cylindrical imperforate sections and screen sections.

FIG. 15 shows a conveyor with 4 discrete leads or blades 302 which do not wrap 360° about the conveyor hub (not shown). Gates 304 and interleaved cylindrical solid wall and perforate sections 306 and 308 are provided to form alternating reslurrying and dewatering compartments 310 and 312. Cake flows in an approximately longitudinal direction as indicated by an arrow 313.

Figure 16:
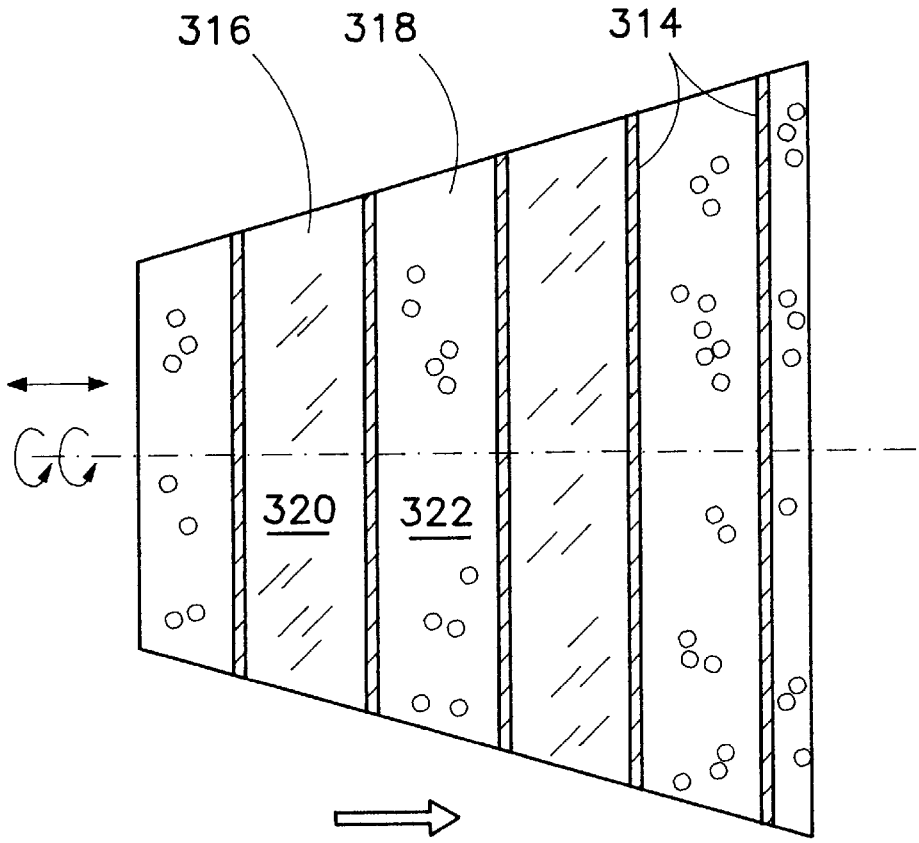
FIG. 16 is a schematic unwrapped or developed view of yet another conical-screen, showing the placement of gates relative to alternating cylindrical imperforate sections and screen sections.
Figure 17:
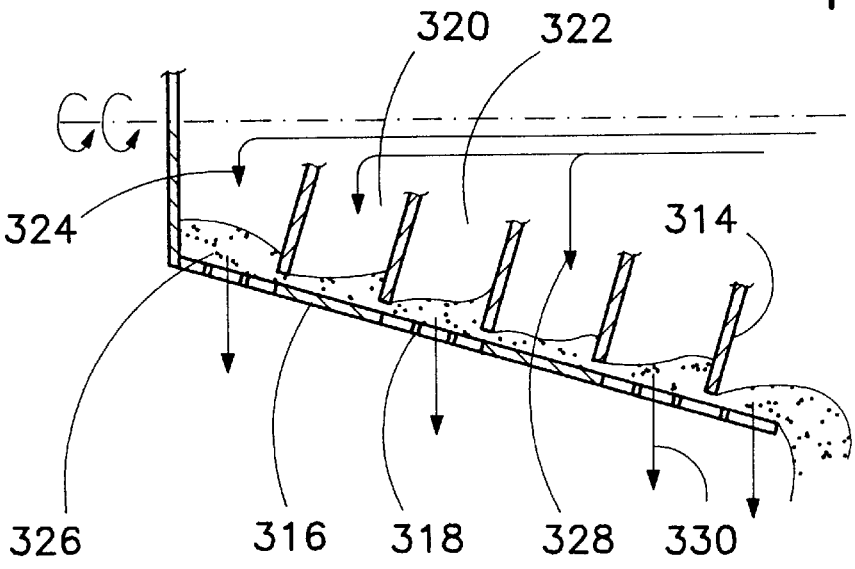
FIG. 17 is a schematic longitudinal cross-sectional view taken along line XVI—XVI in FIG. 16.

As illustrated in FIGS. 16 and 17, a vibrating conical-screen conveyor with a plurality of annular or circumferentially oriented rotating gates or baffles 314. Together with interleaved cylindrical solid wall sections 316 and cylindrical perforate or screen wall sections 318, baffles 314 define a series of alternating reslurrying compartments 320 and dewatering compartments 322. A feed slurry 324 is delivered to an input compartment 326 of the machine, where bulk filtration and cake formation occurs. A wash liquid is provided to reslurrying compartments 320, as indicated by arrows 328. Filtrate 330 exits the centrifuge through screen sections 318.

In the embodiments of FIGS. 14, 15, 16, and 17, the last gate towards the cake discharge end of the machine, at the large diameter end of the conical screen area, provides a means for controlling the retention/residence time of final cake dewatering at maximum centrifugal gravity before the cake is discharged from the machine.

Thus, reslurrying and dewatering as described herein is effective in enhancing the removal of impurities in all types of conical-screen centrifuges, whether including large cone angles with centrifugal gravity driving the cake down the cone or shallow cone angles with a conveyor or vibration driving the cake.

Reslurrying and separation insitu in a single centrifuge provides an important technology allowing substantial purification of difficult-to-wash cake which otherwise could not have achieved with conventional spray or flood wash.

Any gate or baffle which partitions a screening-type centrifuge into reslurrying and dewatering compartments, as discussed hereinabove with reference to FIGS. 5–17, may be formed with a concave profile on an upstream side (as defined by cake flow), as discussed in detail above with reference to FIGS. 2B–4D. More particularly, any such gate or baffle which is oriented substantially perpendicularly to the direction of cake flow, for example, a gate 268 in FIG. 13, may be formed on an upstream side with a substantially cylindrical concave surface **268*a* extending about an axis 268*b*** which is parallel to the cake layer and perpendicular to the cake flow direction, facilitating a turning back of the wetter cake particles in an upper (radially inner) portion of the moving cake layer towards the interior of the compartment on the upstream side of the respective gate.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A centrifuge comprising:

a bowl having an inner surface and a cake discharge opening;

a conveyor for moving cake along a cake flow path extending along said inner surface towards said cake discharge opening; and a baffle mounted to said conveyor upstream of said discharge opening and disposed along said cake flow path, said baffle having a concave surface or profile on an upstream side, said concave surface or profile facing substantially away from said discharge opening.

2. The centrifuge defined in claim 1 wherein said conveyor includes a hub and is provided downstream of said baffle with a gate extending radially outwardly from said hub, said cake having a relatively dry portion and a relatively wet portion, said relative wet portion being located closer than said relatively dry portion to said hub, said gate permitting only said relatively dry portion of said cake to pass to said discharge opening.

3. The centrifuge defined in claim 2 wherein said baffle is a churning vane spaced from said hub to define a first gap therewith, said baffle or churning vane being spaced from said inner surface of said bowl to define a second gap therewith, whereby said relatively dry portion passes through said sccond gap towards said cake discharge opening and said relatively wet portion is returned upstream.

4. The centrifuge defined in claim 3 wherein said conveyor includes a plurality of blade flights attached to said hub, said baffle or churning vane extending between adjacent blade flights of said conveyor and being oriented substantially perpendicularly to said cake flow path.

5. The centrifuge defined in claim 4 wherein said baffle or churning vane includes an extension oriented substantially parallel to and along one of said adjacent blade flights, said extension being provided with a concave surface facing the other of said adjacent blade flights.

6. The centrifuge defined in claim 3 wherein said baffle or churning vane has a concave profile or surface on a downstream side, the concave profile or surface facing toward said cake discharge opening.

7. The centrifuge defined in claim 3 wherein said bowl is taken from the group consisting of a solid bowl and a screen bowl.

8. The centrifuge defined in claim 2 wherein said gate has a concave profile or surface on an upstream side.

9. The centrifuge defined in claim 8 wherein said profile or surface of said gate is substantially cylindrical and extends about an axis oriented generally perpendicularly to said cake flow path.

10. The centrifuge defined in claim 1 wherein said conveyor includes a hub, said baffle being a churning vane spaced from said hub and spaced from said inner surface.

11. The centrifuge defined in claim 10 wherein said conveyor has a plurality of adjacent blade flights, said baffle or churning vane extending between adjacent blade flights of said conveyor and being oriented substantially perpendicularly to said cake flow path.

12. The centrifuge defined in claim 11 wherein said baffle of churning vane includes an extension oriented substantially parallel to and along one of said adjacent blade flights, said extension being provided with a concave surface facing the other of said adjacent blade flights.

13. The centrifuge defined in claim 1 wherein said cake includes particulate material, further comprising spray nozzles disposed upstream of said baffle for spraying said particulate material of said cake.

14. The centrifuge defined in claim 13 wherein said bowl has a compound beach including a sloped first section and a second section of approximately zero slope, said spray nozzles being located at an upstream end of said second section.

15. The centrifuge defined in claim 1 wherein said conveyor includes a hub, said baffle being a gate extending outwardly from said hub, said baffle or gate being spaced from said inner surface of said bowl.

16. The centrifuge defined in claim 1 wherein said baffle is one of a plurality of baffles all having a concave profile or surface on an upstream side, said baffles being spaced from one another along said cake flow path.

17. The centrifuge defined in claim 1 wherein said baffle has a concave profile or surface on a downstream side.

18. The centrifuge defined in claim 1 wherein said conveyor has a plurality of adjacent blade flights, said baffle extending between adjacent blade flights of said conveyor and being oriented substantially perpendicularly to said cake flow path, said baffle including an extension oriented substantially parallel to and along one of said adjacent blade flights, said extension being provided with a concave surface facing another one of said adjacent blade flights.

19. The centrifuge defined in claim 1 wherein said profile or surface is substantially cylindrical and extends about an axis oriented substantially perpendicularly to said cake flow path.

20. A centrifuge comprising:

a bowl having a compound beach with a first beach section and a section beach section of different slope than said first beach section;

a conveyor for moving cake along a cake flow path towards a cake discharge opening in said bowl, said cake having a relatively dry portion and a relatively wet portion, said relative dry portion being located closer than said relatively wet portion to said bowl, said conveyor including a hub, said conveyor further including a gate extending radially outwardly from said hub for cooperating with said compound beach to increase cake retention time and for permitting only said relatively dry portion of said cake to pass to said discharge opening; and spray nozzles attached to said hub for spraying a wash liquid onto a surface of a cake layer disposed on said second beach section.

21. The centrifuge defined in claim 20 wherein said gate has a concave surface or profile on an upstream side, said concave surface or profile facing substantially away from said discharge opening.

* * * * *